US006457756B2

(12) United States Patent
Pronesky et al.

(10) Patent No.: US 6,457,756 B2
(45) Date of Patent: Oct. 1, 2002

(54) DEVICE FOR HANDLING WOOD AND/OR BURNING EMBERS

(76) Inventors: David A. Pronesky, 14456 Hillcrest Rd., Lockport, IL (US) 60441; Peter S. Kopala, 638 N. Marion St., Oak Park, IL (US) 60302

( * ) Notice: Subject to any disclaimer, the term of this patent is extended or adjusted under 35 U.S.C. 154(b) by 0 days.

(21) Appl. No.: 09/782,392

(22) Filed: Feb. 14, 2001

Related U.S. Application Data

(60) Provisional application No. 60/188,849, filed on Mar. 13, 2000.

(51) Int. Cl.[7] ..... F24B 15/10
(52) U.S. Cl. ..... 294/11; 294/19.1
(58) Field of Search ..... 294/11, 19.1, 22, 294/34, 50.8, 50.9, 103.1, 104

(56) References Cited

U.S. PATENT DOCUMENTS 755,454 A * 3/1904 Clear ..... 294/11
824,642 A * 6/1906 Gibbs ..... 294/11
827,561 A * 7/1906 Place ..... 294/11
1,630,013 A * 5/1927 Hyatt ..... 294/11
1,820,463 A * 8/1931 Klein ..... 294/11
1,910,725 A * 5/1933 Valenta ..... 294/11
2,096,104 A * 10/1937 Green ..... 294/11
4,105,238 A * 8/1978 Stright ..... 294/11

* cited by examiner

*Primary Examiner*—Johnny D. Cherry

(57) ABSTRACT

This invention provides a mechanism used for tending to the combustible material in a firebox, furnace, or the like. Use of the unique "sliding/pivoting joint" linkage design allows for a minimum number and complexity of components needed to translate the linear motion of the user's fingers into rotational grabbing motion of the movable jaw. The linkage includes using a slotted hole to both pin the linkage to the main body of the mechanism and allow the linkage to convert linear motion into rotational motion as the linkage both slides along and rotates around this connecting pin. The mechanism has a uniquely designed mechanical linkage which results in minimizing manufacturing costs, while allowing selection of aesthetically pleasing fabrication material. A further use of the implement is grasping and manipulating various objects which arc in a relatively inaccessible or somewhat dangerous positions.

1 Claim, 1 Drawing Sheet

2
4
1
9
5
4
6

7
4
3
8
1 & 2
4
7
8

1
3
2

DEVICE FOR HANDLING WOOD AND/OR BURNING EMBERS

CROSS REFERENCE TO RELATED APPLICATIONS

Provisional Patent Application No. 60/188,849 date May 13, 2000.

STATEMENT REGARDING FEDERALLY SPONSORED RESEARCH OR DEVELOPMENT

Not Applicable

REFERENCE TO A MICROFICHE APPENDIX

Not Applicable

BACKGROUND

Field of Invention

The invention resides in the general field of implements used for carrying and manipulating fire logs and the like.

A further use of the implement is grasping and manipulating various objects which are in a relatively inaccessible or somewhat dangerous position.

SUMMARY

This invention provides a mechanism used for tending to the combustible material in a firebox, furnace, or the like. The mechanism has a uniquely designed mechanical linkage which results in minimizing manufacturing costs, while allowing selection of aesthetically pleasing fabrication material. A further use of the implement is grasping and manipulating various objects which are in a relatively inaccessible or somewhat dangerous positions.

Objects and Advantages

Accordingly, several objects and advantages of this invention are:

1. Use of the unique linkage design allows for a minimum number and complexity of components needed to translate the linear motion of the users fingers into rotational motion of the movable jaw. The linkage includes using a slotted hole to both pin the linkage to the main body of the mechanism and allow the linkage to convert linear motion into rotational motion as the linkage both slides along and rotates around this connecting pin.
2. Use of the unique linkage design allows for a minimum number and complexity of components comprising the mechanism with a resulting decrease in manufacturing costs.
3. The design results in a mechanism with a minimum number of components which require maintenance or replacement.
4. The design results in a mechanism with no delicate components exposed to the heat of the fire being tended, nor components interfering with the area to be occupied by the log.
5. Use of the unique linkage design allows the various components of the mechanism to be fabricated from aesthetically pleasing shapes which are readily available, and inexpensive.
6. The design results in a mechanism which allows the user to stand erect and well away from the heat of the fire he is tending. The comfort and safety of the operator tending to a fire and the economics of the mechanism in the hands of the operator have been carefully considered.

7. The design results in a mechanism which lifts a log from the bottom, while only one hand provides minimal clamping pressure in the process of securely capturing the log prior to moving it.
8. The design results in a mechanism which places the user's hands and arms in positions of leverage while not interfering with the linkage which transmits the clamping force. Manipulation of the mechanism with the captured log is as easy and intuitive as the use of a shovel.
9. The design results in a mechanism which will securely grab a burning log, manipulate it in any attitude, and place it in a fire without itself causing embers to fly.
10. The design of the stationary and movable jaws tends to center the log being grabbed into their curved portion which provides a positive grip.
11. The design of the single "sliding/pivoting joint" allows regulation of the size of the object to be grabbed. The jaws can be made to open from zero inches at a minimum to the diameter of a log whose weight would be considered a reasonable maximum.
12. The design of the linkage system provides a reasonable distance the fingers must open and close in the process of fully operating the movable jaw. The ability of the operator to fully open and close the jaw with his fingers precludes the need for any additional components, such as springs, to bring the jaw to its full range of motion.

Further objects and advantages of this invention will become apparent from the consideration of the drawing and ensuing description.

DRAWING FIGURES

REFERENCE NUMERALS IN DRAWING

Figures 1, 2, 3:
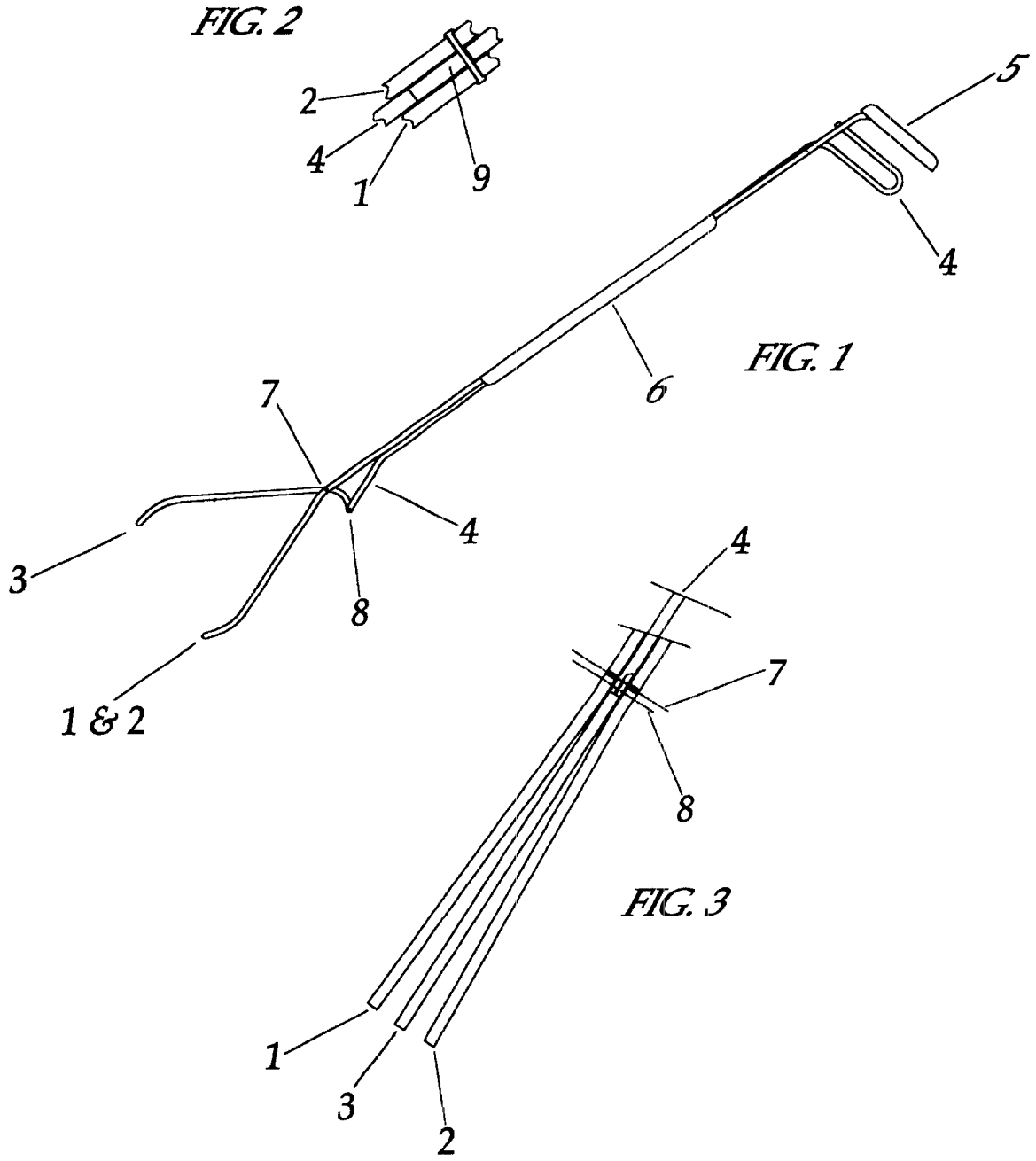
FIG. 1 is a left side view of the invention with the movable jaw #3 completely open.
FIG. 2 is a partial top. view section showing the relationship of members #1, #2, and #4 in the area of the sliding/pivoting joint #9. This view is enlarged and left handle 46 deleted for clarity.
FIG. 3 is a partial bottom view in the area of the jaws showing the splaying of the stationary jaws #1 and #2, as well as the relationship of #1, #2, #3, and #4 in the area of pivot joints #7 and connection point #8. This view is enlarged for clarity.

#1 left side stationary bar
#2 right side stationary bar
#3 movable jaw
#4 sliding bar
#5 right handle
#6 left handle
#7 pivot point
#8 connection point
#9 sliding/pivoting joint

DESCRIPTION

The material used for the construction of the invention is assumed to be square steel bar stock of the same dimension for items #1, #2, #3, and #4, while items #5, and #6 are assumed to be made of wood. Depending upon intent of use, the mechanism may be constructed from a variety of suitable materials. Although described here as a mechanism to tend a fire, further use of the mechanism is grasping and manipulating various objects which are in a relatively inaccessible or somewhat dangerous position. Additionally, the description assumes a right handed operator, although the invention operates equally as well left handed.

Referring to FIG. 1, the left side view of the invention, a left side stationary bar #1 has been bent and splayed out sideways from its longitudinal axis to form one of the two stationary lifting jaws at its one end. Additionally, the opposite end of the left side stationary bar #1 has been bent to form a portion of the right hand grip. A right hand stationary bar #2 is identical to the left side stationary bar #1 in every respect except the splaying out sideways from its longitudinal axis is in the opposite direction from left side stationary bar #1. The splaying out of left side stationary bar #1 and right hand stationary bar #2 at assembly will form the cradle of the stationary jaws in which a burning log will rest. Movable jaw #3 has been bent at one end to form the opposing movable member used to capture the fireplace log or the like. The other end of movable jaw #3 has been bent in such a way as to place movable jaw #3's connections at pivot point #7 and connection point #8 in specific locations, the purpose of which will be described shortly. Sliding bar #4 has been bent at one end to allow mating at assembly to one end of movable jaw #3 at connection point #8. The other end of sliding bar #4 has been bent to form a loop in which the operator's fingers will be placed. Padding material may be added to this finger loop for operator comfort. Of particular note is the sliding/pivoting joint #9 forced in sliding bar #4 and shown in partial top view FIG. 2. Right handle #5 and left handle #6 are shaped to fit comfortably in the operator's hands, and specifically grooved to attach to and hold the left side stationary bar #1 and right side stationary bar #2 in place and a particular distance apart, while allowing the center bar to slide and pivot as required. Dimensions and locations of the bends on movable jaw #3, sliding bar #4, the finger loop in sliding bar #4, pivot points #7 and connection point #8, and sliding/pivot point #9 have been selected to limit the diameter of log which could be placed in the jaws, and allow an adult to fully open and close the jaws with finger movement of the right hand The overall size of the mechanism is intended to keep the operator at a safe distance from the fire he is tending, and allow the leverage needed to manipulate a moderately heavy log.

Assembly of the components at pivot point #7 and connection point #8, as well as sliding/pivot joint #9 is by mechanical fasteners, such as rivets or the like. Attachment of right handle #5 and left handle #6 to left side stationary bar #1 and right side stationary bar #2 may be by an appropriate adhesive or the like. Movable jaw #3 and sliding bar #4 are thinned so that when joined at connection point #8 their combine thickness will approximate the initial thickness of the stock used on each. This thinning allows movable jaw #3 and sliding bar #4 to fit between left side stationary bar #1 and right side stationary bar #2 as if one continuous bar. Movable jaw #3 and sliding bar #4 having been joined at connection point #8, are placed between left side stationary bar #1 and right side stationary bar #2 and joined at pivot point #7 and sliding/pivot point #9. An aesthetically pleasing finish, such as black oxide, may be applied at this time. Right handle #5 and left handle #6 are now joined as shown in FIG. 1.

OPERATION

The description of operation of the invention assumes a right handed operator, although the invention operates equally as well left handed.

The fingers of the operator's right hand are placed in the looped and of sliding bar #4, the remainder of the right hand and thumb around right handle #5, and the left hand grips anywhere comfortable along left handle #6. Having taken the mechanism in hand, the operator places the stationary jaws of left side stationary bar #1 and right side stationary bar #2 under the log to be manipulated, closes his right hand fingers in the finger loop in sliding bar #4 causing the movable jaw #3 to capture the log. After manipulation of the log, the fingers of the right hand arc opened, contacting the front portion of the finger loop in sliding bar #4, forcing open the movable jaw #3 and releasing the log in the desired location.

Conclusion, Ramification, and Scope

Use of the unique "sliding/pivoting joint #]" linkage design allows for a minimum number and complexity of components needed to translate the linear motion of the user's fingers into rotational motion of the movable jaw.

Use of the unique linkage design, including the sliding/pivot point #9 allows for a minimum number and complexity of components comprising the mechanism with accompanying manufacturing and maintenance savings.

Use of the unique linkage design, including the sliding/pivot point #9 allows the various components of the mechanism to be fabricated from aesthetically pleasing shapes which are readily available, and inexpensive.

The design of the linkage system provides a reasonable distance the fingers must open and close in the process of fully operating the movable jaw. The ability of the operator to fully open and close the jaw with his fingers precludes the need for any additional components, such as springs, to bring the jaw to its full range of motion.

The design results in a mechanism which allows the user to stand erect and well away from the heat of the fire he is tending. The comfort and safety of the operator tending to a fire and the ergonomics of the mechanism in the hands of the operator have been carefully considered.

We claim:

1. An article handling mechanism for manipulating a fire log or the like. comprising.

a. an opposed stationary jaw means and a movable jaw means;

b. a pivot point interconnection between said stationary jaw means and said movable jaw means;

c. a left side stationary bar means and a right side stationary bar means each having formed at one end said stationary jaw means and a hand grip formed at their other end;

d. a sliding bar with one end attached to a connection point end of said movable jaw means, the length of said sliding bar sandwiched between and connected at a predetermined point approximately ⅔rds the length of the sliding bar away from said connection point end to said left side stationary bar means and said right side stationary bar means by a cross pin through holes in the left side stationary bar means and the right side stationary bar means and through a slotted hole in the sliding bar forming a sliding/pivoting joint and allowing linear motion of the sliding bar between the left side stationary bar means and the right side stationary bar means to produce rotational motion of the movable jaw means;

e. at the end opposite Of said connection point end said sliding bar forms a loop into which an operator's fingers are placed, the movement of which provides the force for the linear motion of the sliding bar; and f. a right handle means and a left handle means which are shaped to fit in the operator's hands, and specifically grooved to attach to and hold said left side stationary bar means and said right side stationary bar means in place and a particular distance apart, while allowing said sliding bar to slide and pivot as required.

* * * * *